United States Patent [19]

Simpson

[11] 4,311,212

[45] Jan. 19, 1982

[54] VALVE CONTROL SYSTEM

[75] Inventor: Elmer J. Simpson, Margate, Fla.

[73] Assignee: Elevator Equipment Co., Los Angeles, Calif.

[21] Appl. No.: 167,388

[22] Filed: Jul. 9, 1980

[51] Int. Cl.[3] ..... B66B 1/04

[52] U.S. Cl. ..... 187/29 A

[58] Field of Search ..... 187/29; 318/313, 461, 318/640, 663, 674

[56] References Cited

U.S. PATENT DOCUMENTS

| | | | |
|---|---|---|---|
| 3,119,501 | 1/1964 | Lemelson | 187/29 X |
| 3,187,844 | 6/1965 | MacNair et al. | 187/29 |
| 3,553,560 | 1/1971 | Lemen | 318/313 X |
| 3,963,098 | 6/1976 | Lewis et al. | 187/29 |
| 3,977,497 | 8/1976 | McMurray | 187/29 |
| 4,034,275 | 7/1977 | Mangel | 187/29 X |
| 4,276,506 | 6/1981 | Little | 318/313 X |

*Primary Examiner*—J. V. Truhe
*Assistant Examiner*—W. E. Duncanson, Jr.
*Attorney, Agent, or Firm*—Vernon D. Beehler

[57] ABSTRACT

A hydraulic elevator is employed having the usual call buttons at the respective floors and selector buttons for all floors located in the elevator cab. When a button is pushed to select a floor to which the cab is to travel, up or down, as the case may be, the cab starts moving slowly in the selected direction. During initial movement a cam on the cab triggers components in an electric circuit which, by motivating hydraulic valving causes the cab initially to accelerate to a selected rate of travel after which travel proceeds at the selected rate to a slow down point. At that point another component is triggered and the valving causes the cab to decelerate for a selected interval of travel, after which the cab moves slowly to the level to which it was called.

The invention here disclosed is one of a balanced electric bridge circuit which is made constantly sensitive to the rate of travel of the cab by use of a stationary tape extending for the full height of the vertical hoist way. The tape has in it a series of perforations through which light passes from a light emitting diode to a photodetector. Fluctuations in the amount of light caused by changes in speed of travel of the elevator cab causes a constant rebalancing of the resistance conditions in one side or the other of an electric bridge circuit whereby to constantly return the travel of the cab to the selected rate, the deviations being so quickly compensated for as to be unnoticed by the occupants of the cab.

17 Claims, 12 Drawing Figures

UP LIMIT
UP SLOW
UP LEVEL
UP SLOW
DOWN SLOW
DOWN LEVEL
UP LEVEL
UP SLOW
DOWN SLOW
DOWN LEVEL
DOWN SLOW
DOWN LIMIT
LOAD
3rd FLOOR
2nd FLOOR
1st FLOOR
-14-

LEVELING
TRANSITING
HIGH SPEED
ACCELERATING

VALVE CONTROL SYSTEM

For certain types of buildings which are not of great height, elevators which operate by hydraulic power have a wide degree of acceptance. On some occasions it is a matter of economy and on others a matter of servicing a hydraulic circuit. There are however, characteristics of a hydraulic circuit which need to be taken into consideration to enhance the acceptability of hydraulic power. For example, hydraulic fluid, which is depended upon, may vary as to its specific gravity and also as to its viscosity. Where changes in temperature are experienced, particularly wide changes in temperature, the viscosity of the hydraulic fluid may well vary appreciably from one season to another and even from one part of the day to another. As a consequence, the fluid when flowing through valves and controls in cold condition performs in a manner different from the same fluid flowing through such valves and controls in heated condition, the result being that although a system may be timed in a perfectly acceptable manner for a cold condition, it may be appreciably off for a different condition.

Another factor influencing the performance of hydraulic elevators is that of variations in load, the result of which is an immediate change in the pressure present in the hydraulic circuit. For lifting the elevator cab and its load, pressure must be applied and the need for pressure varies with the load. Since in the functioning of a hydraulic elevator there is constant need for the hydraulic fluid to pass through orifices in the valving, the speed at which the fluid will pass through such valving under high pressure will vary appreciably from the speed under low pressure. Such factors have an effect upon the performance of the elevator cab, particularly when it approaches a floor level to which it is called. When an elevator is called from one floor to another initial movement is one of acceleration until full speed is reached for the greater portion of the distance traveled from one floor to another. As the elevator cab approaches the floor to which it is called, initially there is a slow down in speed arranged for which concludes with a leveling off speed close to the floor to which it is called immediately preceeding stop. Changes in load on the elevator can have an appreciable effect upon the slow down speed and distance traveled as well as the leveling off distance. Similar variation may be experienced in the accelerating phase of the cycle.

Although some adaptations of electric circuits have been attempted for the control of hydraulic elevator circuits, the tendency has been one of increasing the complexity of what previously has been relatively simple hydraulic control without attendant advantages.

It is therefore one of the objects of the invention to provide a new and improved control system for a hydraulic powered elevator which is relatively simple in its construction and operation and which experiences a minimal degree of variance under conditions where there may be wide variations in load and also appreciable changes in temperature.

Another object of the invention is to provide a new and improved control system for a hydraulic elevator which is constantly compensating for potential differences in the speed of travel of the elevator cab to the extent that once set for a preferred speed of travel, acceleration and deceleration, the same rate will be maintained despite variations in other conditions, such as weight and temperature.

Still another object of the invention is to provide a new and improved control system for hydraulic actuated elevators which finds special acceptability when coupled with a rotary type control valve to the extent that the control valve may be rotated by an electric motor to its different positions of adjustment, the motor in turn being readily subject to a circuit causing it to rotate in one direction or the other or to hold in a fixed position of rotation so that progress of the elevator cab will remain constant.

Still further among the objects of the invention is to provide a new and improved control system for a hydraulic actuated elevator which makes use of the actual speed of travel of the cab itself as a means for modifying the control circuit in order that the speed remain consistently at a desired setting, whether for acceleration, deceleration or uniform motion at full speed.

With these and other objects in view the invention consists of the construction, arrangement and combination of the various parts of the device serving as an example only of one or more embodiments of the invention, whereby the objects contemplated are attained, as hereinafter disclosed in the specification and drawings, and pointed out in the appended claims.

IN THE DRAWINGS

Figure 5A:
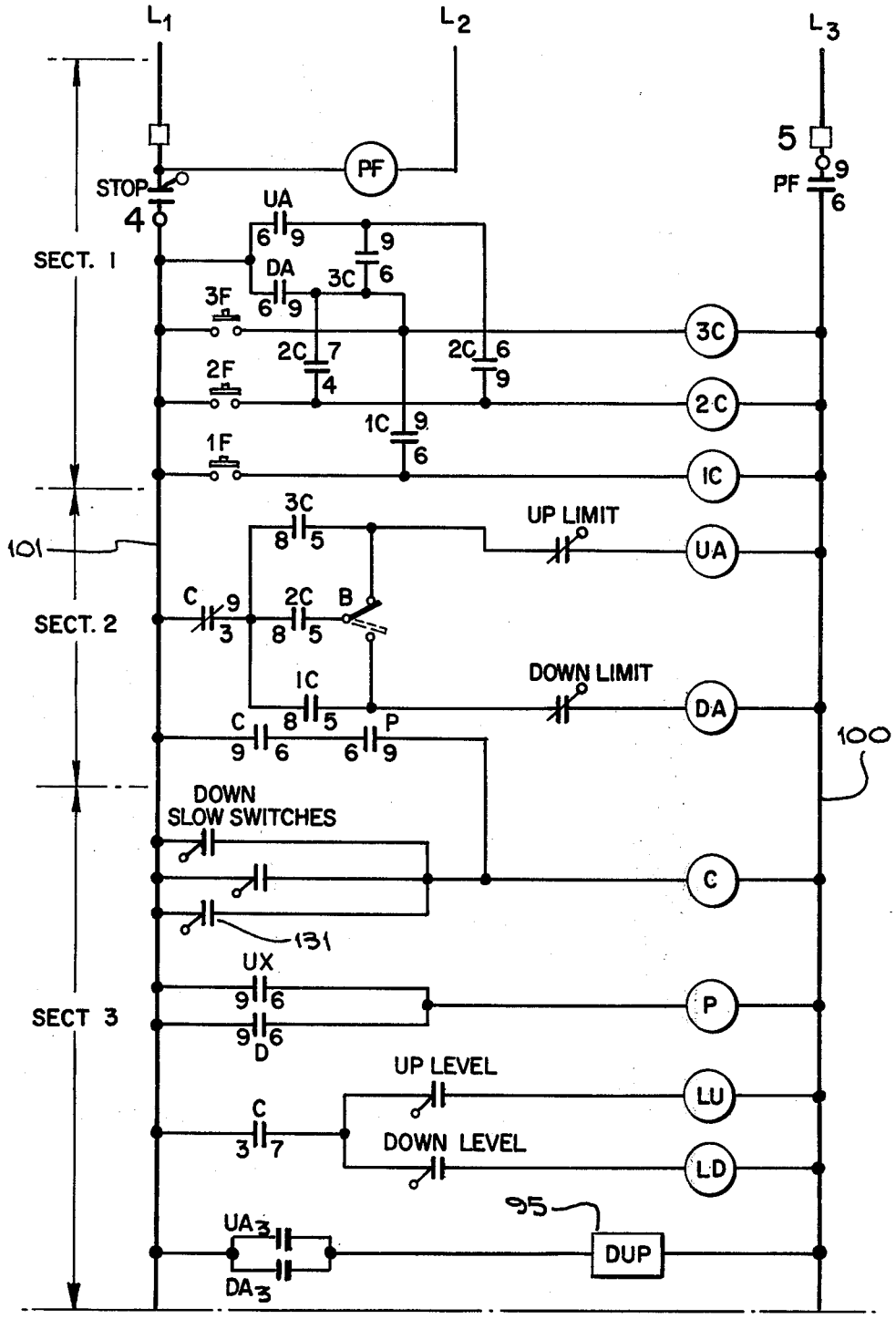

FIG. 5*a*, is a circuit diagram of three sections of the main elevator circuit.

Figure 5B:
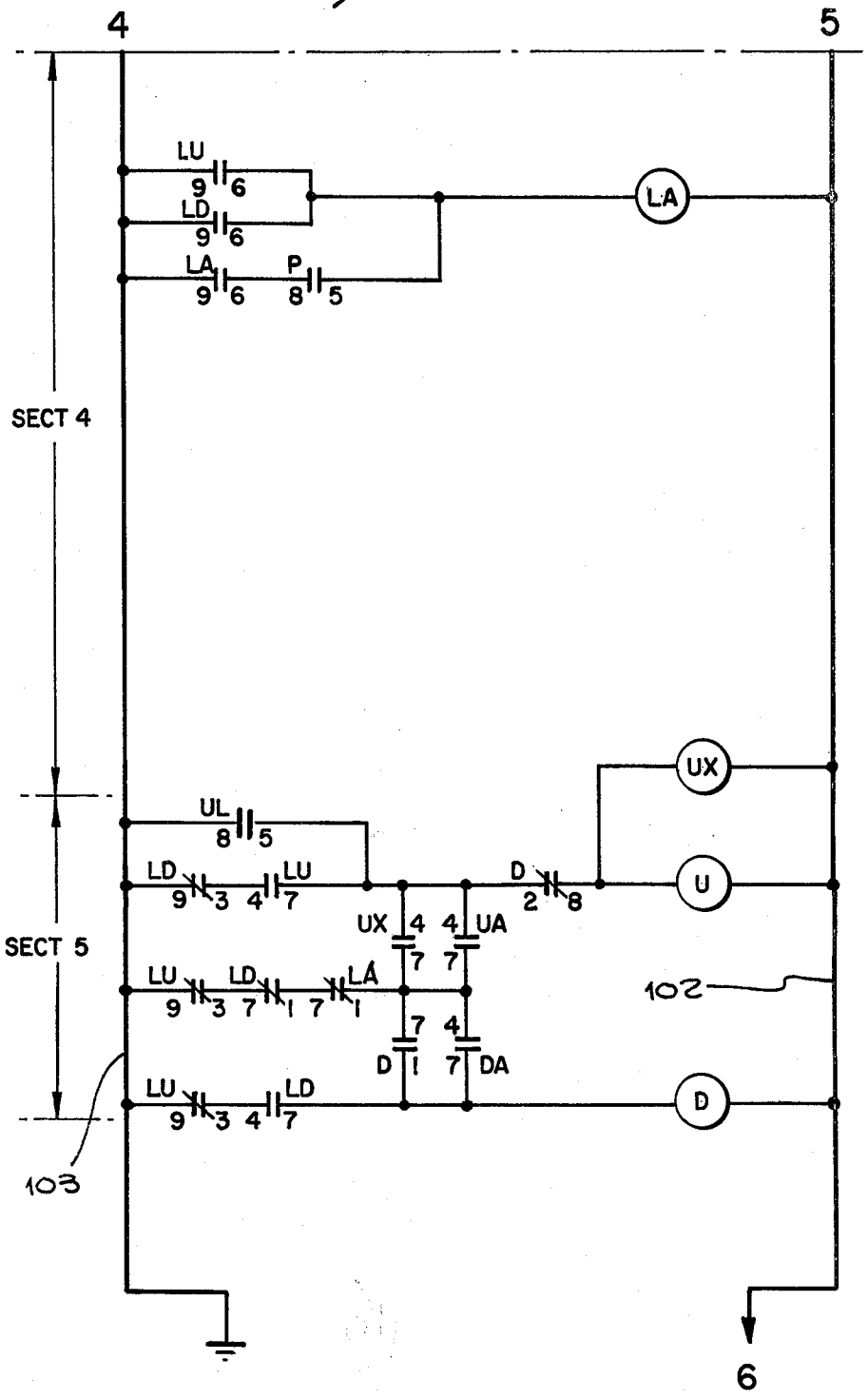

FIG. 5*b*, is a circuit diagram of two additional sections of the main elevator circuit.

Figure 6A:
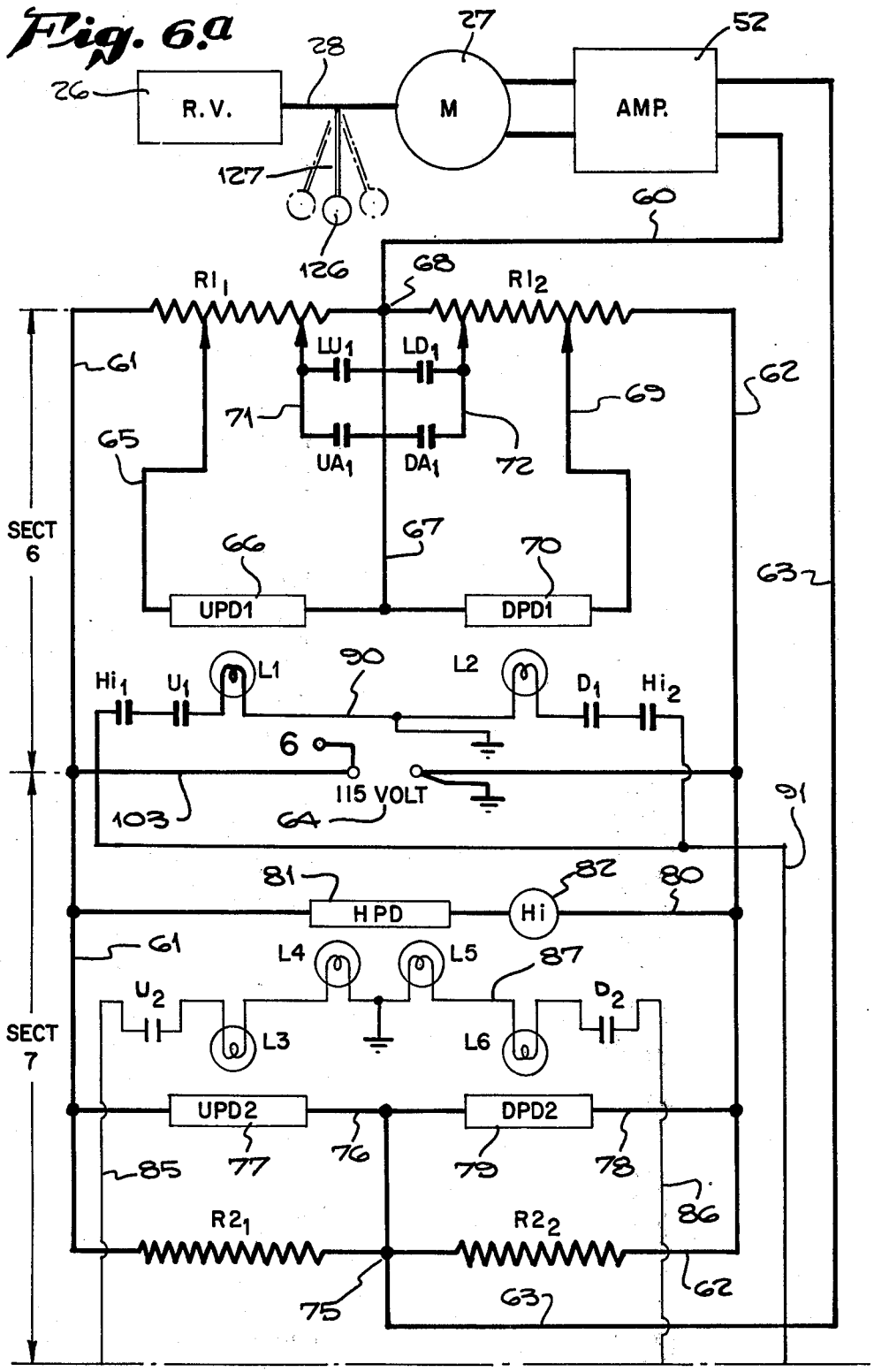

FIG. 6*a*, is a circuit diagram of the balance bridge circuit.

Figure 6B:
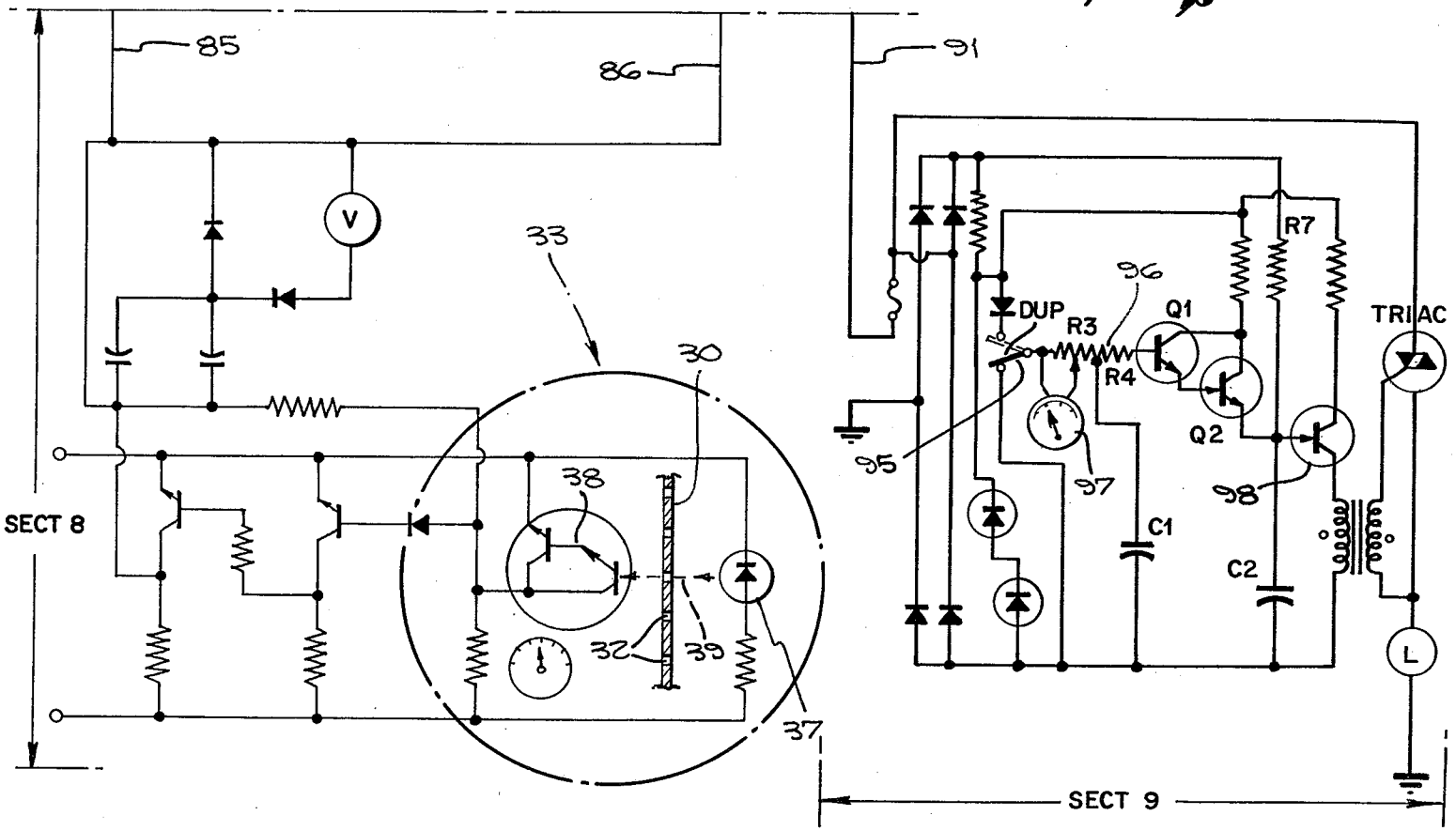

FIG. 6*b*, is a circuit diagram showing the speed monitoring circuit as section 8 and the speed control circuit as section 9.

Figures 7, 8, 9, 10:
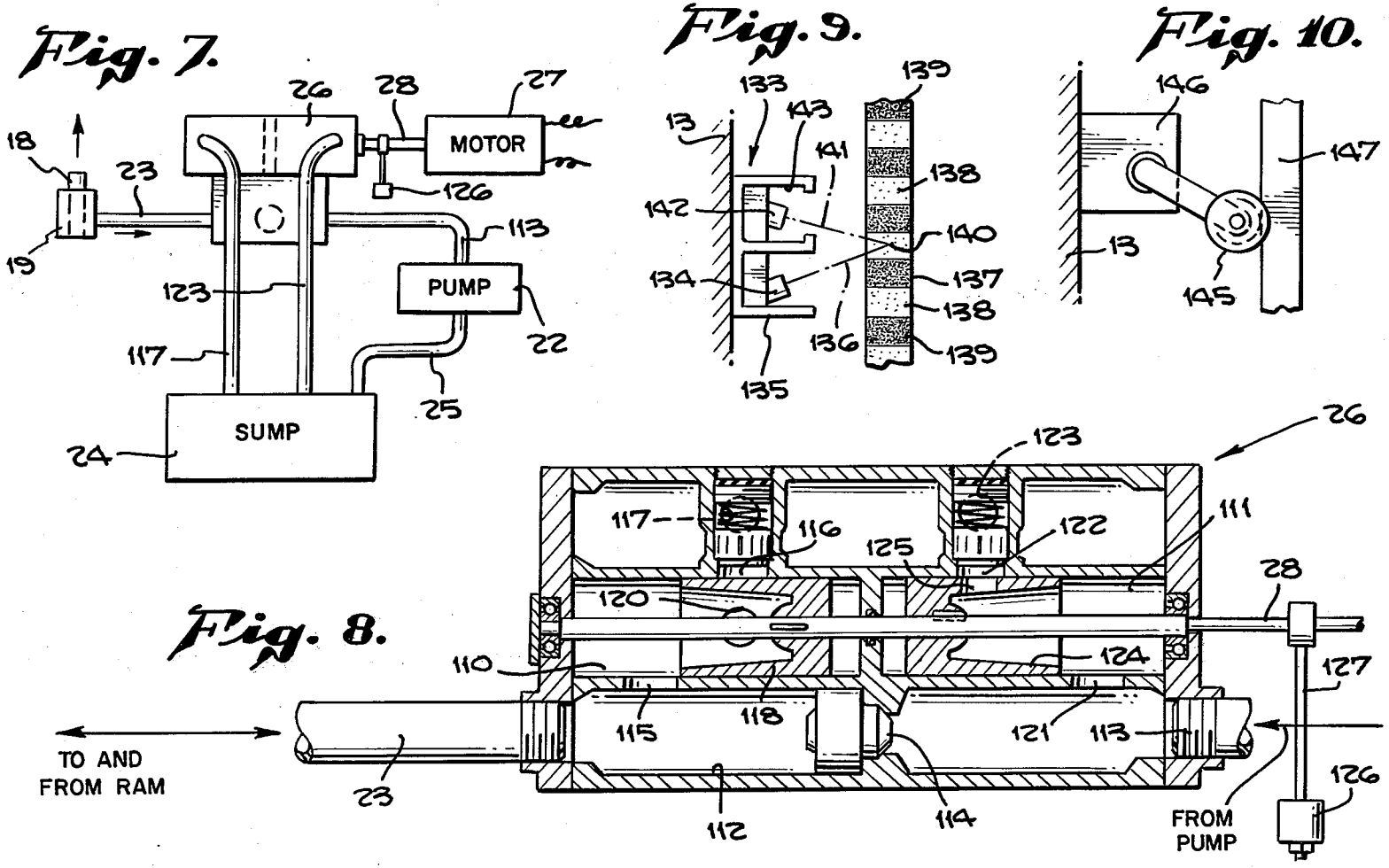

FIG. 7, is a schematic diagram showing the relationship of the rotary hydraulic valve to the motor, the pump, the sump and the lifting ram.

FIG. 8, is a longitudinal sectional view of the rotary valve of FIG. 7.

FIG. 9 is an enlarged side elevational view of a second form of scanner on the elevator cab.

FIG. 10 is a schematic representation of still another form of scanner.

Figure 1:
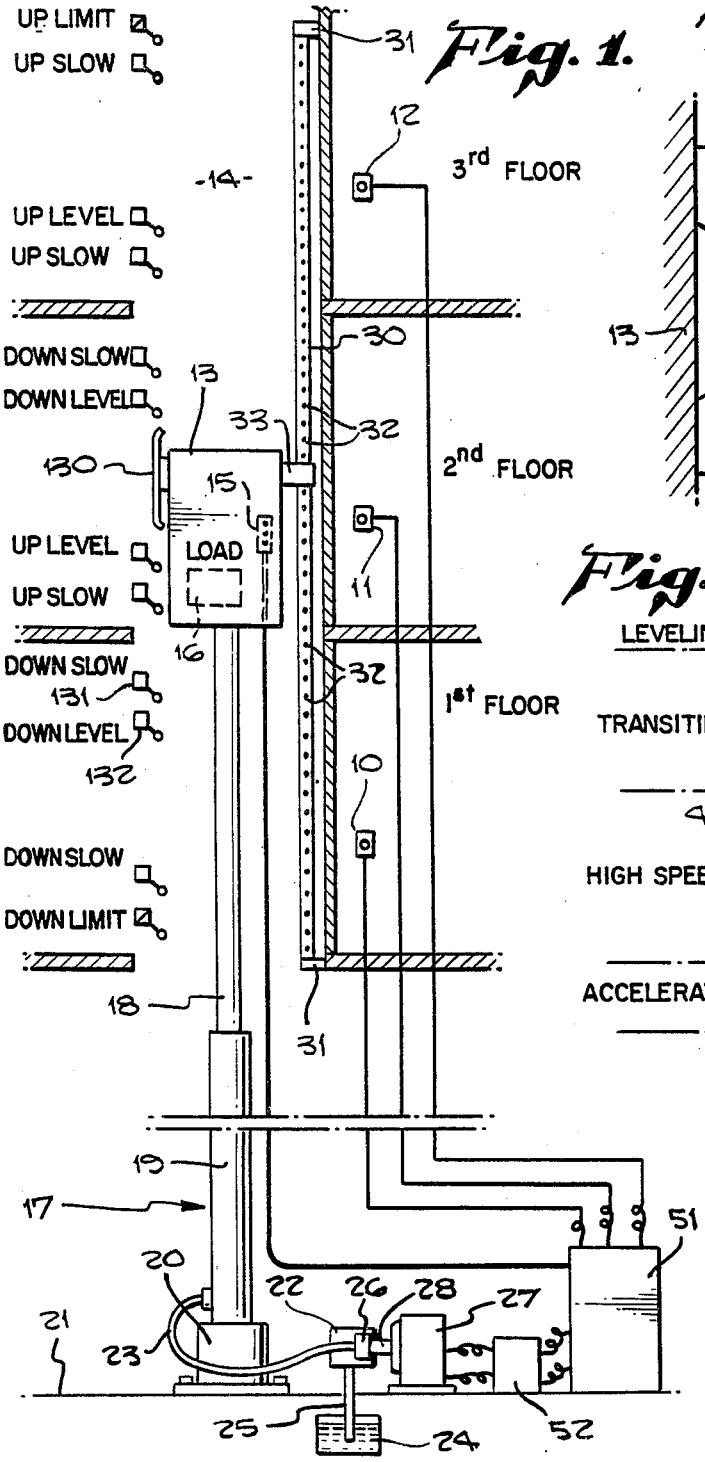
FIG. 1, is an elevational view showing the hydraulic elevator and its operational system in relation to a three story building shown in section.

In an embodiment of the invention chosen for the purpose of illustration, there is shown in FIG. 1 a characteristic three-story structure showing a lower first floor, a middle second floor and an upper third floor with respective call buttons 10, 11 and 12. The elevator is depicted as a cab 13 for travel up and down within a hoist way. In the cab is depicted a panel 15 with buttons for the respective first, second and third floors, a load being depicted at 16.

A hydraulic ram indicated generally by the reference character 17 comprises a piston 18 which supports the cab, the piston extending telescopically into a power cylinder 19 supported by a footing 20 on a floor surface 21 in the basement of the structure.

For operating the ram there is a pump 22 connected to the cylinder 19 by a fluid line 23 and communicating with a reservoir or sump 24 by way of a fluid line 25. A rotary valve 26 of the pump 22 is supplied with power by a motor 27 and drive shaft 28. Further particulars respecting the motor, valve, and associated parts are shown in FIGS. 7 and 8.

Of particular consequence is the provision of a strip 30 in the form of a steel tape which is mounted stationarily in the hoist way 14 on suitable brackets 31. Throughout the length of the strip is a series of transversely extending perforations 32. In practice the perforations may be holes of relatively small diameter spaced at one quarter (¼) inch intervals throughout the length of the tape. Cooperating with the perforations is a scanner 33 which includes a bracket 34 anchored on the wall of the cab 13, the bracket including spaced arms 35 and 36 for supporting respectively a source of illumination in the form of a light emitting diode or LED 37 and a photodetector 38 on the arm 36. The LED 37 and photodetector 38 form between them a path of illumination indicated by the broken line 39. The path of illumination is in a position such that it is able to periodically pass through a succession of the perforations 32 as the cab moves up and down within the hoist way 14.

Figure 2:
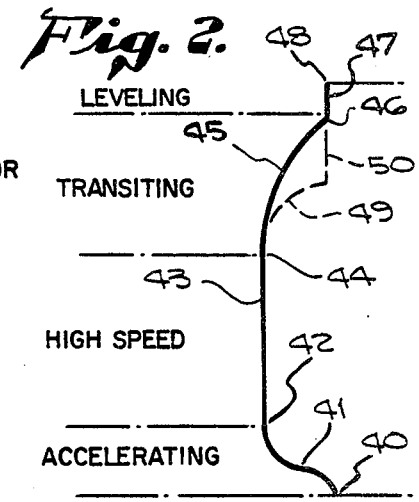
FIG. 2, is a graph depicting the change in speed of an elevator cab in traveling upwardly from one floor to another.

The desired pattern of travel for the cab 13 as it is moved from floor to floor is shown in FIG. 2. Assuming just by way of example that the cab at rest is to move upwardly from a stationary position at one floor, the pattern of movement, as illustrated by the curve of FIG. 2, is initially one of progressive acceleration from a stationary point 40 through the curve 41 to a point on 42 where the high speed phase is reached. From point 42 the pattern is for cab travel throughout the curve 43 at high or full speed to a point 44, at which it commences decelerating or transiting. Transiting occurs throughout the curve on 45 until a point 46 is reached at which point the cab follows a leveling phase 47 until it stops at a floor level point 48. It is interesting to note that where the curve as depicted in full lines may show the pattern of travel of a relatively empty cab, a loaded cab may follow a more rapidly decelerating and shorter transiting curve, indicated by the broken line 49, and a relatively longer leveling phase indicated by the broken line 50 added to the leveling phase 47.

The electronics for operating the system may be assumed as being housed within a cabinet 51, the electronics being in communication with an amplifier 52 for the motor 27, the amplifier being of substantially conventional construction.

To control movement of a hydraulically operated elevator cab 13 of the type described, a system is made use of which consists of interrelated circuits comprising a main electric circuit for overall control, and a balance bridge circuit for shifting the rotary hydraulic valve between settings which move the cab up or down as called for. Additional interdependent circuits make up the remainder of the system.

The main electric elevator circuit for overall control is shown in FIGS. 5*a* and 5*b*. A balance bridge circuit is shown in FIG. 6*a* wherein operation of the motor is balanced between sections 6 and 7. The balancing is a combination of response on the one hand to a speed control circuit shown as section 9 of FIG. 6*b* which can be selectively set and a speed monitoring circuit or signal unit illustrated by section 8 of FIG. 6*b* which is responsive to an electric current initiated by the scanner 33. The current is created when the light path from the LED 37 is picked up by the photodetector 38 in proportion to the rate of travel of the cab up and down within the hoist way. Quite fundamentally, the faster the speed of travel, the greater will be the current passed by the scanner through the perforations 32, while conversely for slower travel of the cab and the scanner, less electric current will flow from the scanner.

THE BALANCE BRIDGE CIRCUIT

In section 6 of FIG. 6*b* are depicted components, the function of which is to rotate the motor 27 and accompanying rotary valve 26 in one direction. In section 7 of FIG. 6*a* are components, the function of which is to rotate the motor 27 and accompanying rotary valve 26 in the opposite direction. It follows that when action of the sections 6 and 7 is balanced, the motor and accompanying rotary valve will remain immovable at a fixed setting until something occurs to unbalance the sections. Components at the right of sections 6 and 7 function during down travel whereas components at the left of sections 6 and 7 function during up travel.

More particularly there are in section 6 two resistances, respectively $R1_1$ and $R1_2$, connected at one terminal to the amplifier 52 by a line 60. A line 61 connects the other terminal of resistance $R1_1$ to the circuit, and a line 62 connects the other terminal of resistance $R1_2$ to the circuit. In section 7 are comparable resistances $R2_1$ and $R2_2$ connected to the circuit at one terminal by the same lines 61 and 62 and to the amplifier by the line 63. The circuit is in communication with a 115 volt alternating current source 64.

For potentially bypassing the resistance $R1_1$ there is a line 65 in which is a UPD 1 (up photodetector 1) identified by the reference character 66, which is connected at its opposite terminal through a line 67 to a junction 68 of the two resistances. Similarly on the right the resistance $R1_2$ is potentially bypassed by a line 69 in which is a DPD1 (down photodetector 1) identified by the reference character 70, likewise connected through the line 67 to the junction 68. The UPD1 and the DPD1 is in each instance a unit which in darkness is infinitely resistant to the conduction of electric current, but which conducts current proportionately to the light which strikes it.

Connected in the circuit, adjacent the resistance $R1_1$ by means of a line 71, are an up pilot relay element $UA_1$ and an up level relay element $LU_1$. Correspondingly for the resistance $R1_2$ there is in a line 72 a down pilot relay element $DA_1$ and a down level relay element $LD_1$.

In section 7 of FIG. 6*a* on the left is a resistance $R2_1$, with a corresponding resistance $R2_2$ on the right, interconnected at a junction 75 through the line 63 with the amplifier 52. A bypass line 76 for the relay $R2_1$ has in it an up photodetector 77 identified as $UPD_2$ whereas a bypass line 78 for the relay $R2_2$ has in it a down photodetector 79 and identified as DPD2.

Interconnecting opposite terminals of the resistances of $R2_1$ and $R2_2$ by way of line 61 and 62 is a transverse line 80 in which is HPD (high speed photodetector) 81 and Hi (high speed relay) 82.

Intercommunicating with the circuit and its components just described in connection with FIG. 6*a* is the speed monitoring circuit, the motivating portions of which are shown in section 8 of 6*b* with those portions directly influencing the balance bridge circuit of FIG. 6*a* depicted within Section 7 of FIG. 6*a*. In this respect monitor lines 85 and 86 on respectively opposite sides of section 7 have interconnected between them a transverse line 87 within which components are connected in series. Among the components is a lamp L6 positioned to illuminate $DPD_2$, a lamp L5 positioned to illuminate HPD, a second lamp L4 positioned to illuminate HPD and a lamp L3 positioned to illuminate $UPD_2$. Also in the line 87 is a down run relay indicated by the character $D_2$ and an up run relay indicated by the character $U_2$.

Additionally intercommunicating with portions of the balance bridge circuit of FIG. 6*a* is the speed control circuit, motivating portions of which appear in the circuit of section 9 of FIG. 6*b*. Those portions which directly influence the components of the circuit of 6*a* are shown connected in series on the left and right branches of a transverse line 90. On the left for example is a lamp indicated by the reference character L1 which illuminates UPD1 identified by the reference character 66. In series with L1 is an up run relay $U_1$ and an element $Hi_1$ of the high speed relay, previously identified as 82. On the right is the lamp L2 which illuminates DPD1 identified by the reference character 70. In series with L2 is a down run relay indicated by the character $D_1$ and an element $Hi_2$ of the high speed relay Hi previously indicated by the reference character 82. A connecting control line 91 interconnects with the speed control circuit shown in further detail in section 9 of FIG. 6*b*.

THE SPEED MONITORING CIRCUIT

The speed monitoring circuit previously made reference to is shown in further particular in section 8 of FIG. 6*b*. The circuit in effect functions as a signal unit. As there depicted motivation of the circuit stems from the tape 30 where the path of illumination 39 traverses the perforations 32. As shown in section 8 of FIG. 6*b*, the current generated in the photodetector, upon appropriate amplification by substantially conventional components in the circuit, is fed through lines 85 and 86 to the lamps L6, L5, L4, and L3 at their locations in the balance bridge circuit of FIG. 6*a*.

THE SPEED CONTROL CIRCUIT

Brightening and dimming of the lamps L1 and L2 at their locations in the balance bridge circuit, section 6 of FIG. 6*a*, is accomplished by the speed control circuit shown in further detail in section 9 of FIG. 6*b*. In the circuit last made reference to is a DUP (down/up switch) identified by the reference character 95, the switch being connected to a resistance 96. A rheostat 97 may be employed to control the output of the speed control circuit. A time dependent output is obtained after initially energizing the circuit. Slow turn on or turn off is obtained after the position of the switch 95 is changed. When the switch is placed in the up position a capacitor C1 begins to charge through R4 and R3 of the resistance 96. For time periods shortly after switching the capacitor voltage is low. This holds the base of transistor Q1 down and thus the emitter of the transistor Q2 is held at a low voltage below the peak point voltage on a unijunction transistor 98. Simultaneously a capacitor C2 is charged during each half-cycle through a resistance R7. The time constant of the combination of resistance R2 and capacitor C2 is relatively long compared to a half cycle of the line voltage. This time constant is selected so that the capacitor voltage just barely reaches the peak point voltage at the end of the half cycle with zero voltage on the capacitor C1. As the voltage of the capacitor C1 rises, the voltage of the capacitor C2 also rises and the combined R7-C2 charging curve starts from a slightly higher voltage at each cycle. The result of this is that voltage on the capacitor C2 reaches the peak point voltage of the unijunction transistor 98 slightly earlier during each cycle, thus gently increasing the output. The double emitter follower configuration comprising the transistors Q1-Q2 provides an extremely high impedance so that the charging and discharge currents to the capacitor C1 are not shunted away from it. When the switch 95 is moved to the down position, the capacitor C1 discharges through the resistances R4 and R3. The operation then proceeds as previously but in reverse.

THE MAIN ELECTRIC CIRCUIT

For an understanding of the main electric circuit and its relationship to the balance bridge circuit and the interconnecting circuits reference is made to FIGS. 5*a* and 5*b* to which power may be supplied by connections to a three phase power source at points L1, L2, and L3. That portion of the main circuit shown in FIG. 5*b* interconnects with the circuit as depicted in FIG. 5*a* at respectively points 4 and 5.

In section 1 of FIG. 5*a* switches 1F, 2F and 3F correspond respectively with call buttons for the first floor, second floor and third floor, and also the corresponding call buttons of the panel 15 of the cab 13. In series with the switch 1F is a relay 1C. Similarly there is a relay 2C in series with the switch 2F and a relay 3C in series with switch 3F. Relay elements corresponding respectively with the relays 1C, 2C and 3C are similarly designated, as for example the relay element $1C_6^9$ for the relay 1C. The parts made reference to may be found located in sections 1 and 2 of FIG. 5*a*. There is also located in section 2 of FIG. 5*a* an up pilot relay UA and a down pilot relay DA, in series with a closed relay element $C_3^9$ of a relay C, the latter being located in section 3 of FIG. 5*a*. An up limit switch and a down limit switch are so designated, connected respectively to the up pilot relay UA and down pilot relay DA. To corelate the main electric circuit of FIG. 5*a* with the balance bridge circuit of FIG. 6*a* attention is called to the presence of the up pilot relay element UA1 in line 71 of section 6 FIG. 6*a* and the down pilot relay element DA1 in line 72 of the same section 6.

Correspondingly in section 3 of FIG. 5*a* are located an up level relay LU and a down level relay LD in parallel with respect to each other but in series with a relay element $C_7^3$ of the relay C. Again to corelate the main electric circuit of FIG. 5*a* with a balance bridge circuit of 6*a* attention is directed to the presence of the up level relay element LU1 in the line 71 of section 6 FIG. 6*a* and the presence of the up level relay element LD1 in line 72 of section 6, FIG. 6*a*.

All of the relay elements last mentioned have one terminal connected to a main circuit line 100 and the opposite terminal connected to a main circuit line 101.

The remaining portion of the main electric circuit shown FIG. 5*b* includes an up run relay U and a down run relay D located in section 5, one terminal of each being connected to a main circuit line 102 and the other terminal of each being connected to a main circuit line 103. Again to interrelate the main electric circuit of FIG. 5*b* with the balance bridge circuit of FIG. 6*a*, attention is directed to the presence of the up run relay elements U1 and U2, the element U1 being in line 90 shown in section 6, FIG. 6*a*, and the element U2 being in line 87, section 7 FIG. 6*a*. Similarly, the down run relay element D1 is located in line 90 shown in section 6 FIG. 6*a* and the down run relay element D2 in line 87 of section 7, FIG. 6*a*.

It should further be noted for the purpose of interrelation that main circuit line 102 shown in FIG. 5*b*, at the point 6 connects to the balance bridge circuit 6*a* at the point 6 of a balance bridge circuit line 103 between sections 6 and 7.

THE ROTARY VALVE

To assist in understanding the special attributes of the electrical phase of the valve control system when applied to operation of the hydraulic elevator, attention is directed to further particulars of an acceptable rotary type valve shown in FIGS. 7 and 8. Initial disclosure of FIGS. 7 and 8 appears in copending application Ser. No. 127,767 filed Mar. 6, 1980.

In addition to the general arrangement of the motor 27, the rotary valve 26, the sump pump 22 and the cylinder some interior details of the rotary valve 26 are shown and their relationship to the hydraulic circuit. As appearing in FIG. 8, the rotary valve 26 has centrally disposed chambers 110 and 111 in axial alignment, the chambers being parallel to a cylindrical chamber 112. A fluid line 113 at one end of the cylindrical chamber 112 connects to the pump 22 and the fluid line 23 at the other end of the cylindrical chamber 112 connects to the cylinder 19 of the ram 17. There is a check valve 114 midway between opposite ends of the cylindrical chamber 112 which opens to flow from the fluid line 113 to the fluid line 23, closing against flow in the opposite direction.

A port 115 provides communication between the cylindrical chamber 112 and a chamber 110. Another port 116 communicates between the chamber 110 and a return fluid line 117 from the valve 26 to the sump 24. A valve element 118 keyed for rotation with a shaft 119 has in it a valve port 120 which is adapted to be rotated to a position coinciding with the port 116 in open position.

At the opposite end of the cylindrical chamber 112 is a port 121 in communication with the chamber 111. Another port 122 communicates between the chamber 111 and a second return fluid line 123 to the sump 24. A valve element 124 keyed to the shaft 28 has in it a valve port 125 which is adapted to open and close with respect to the port 122. It should be noted that the valve port 125 has a rotated position removed 90 degrees from the position of the valve port 120, so that when one valve port is opened the other valve port is closed.

Also on the shaft 28 is a pendulum 126 at the end of a pendulum shaft 127, the pendulum shaft in turn being anchored to the shaft 28.

For operation of the rotary valve in the up mode the pump 22 is turned on. The shaft 28 then rotates to a position such that both of the valve ports 120 and 125 block passage of hydraulic fluid through the ports 116 and 122. Consequently the only route for fluid coming from the pump 22 is through the check valve 114 into the cylinder 119 of the hydraulic ram. This fluid under pressure as a consequence forces the piston 18 upwardly so as to raise the elevator cab 13.

To operate in the down mode the shaft 28 is rotated to a position where the valve port 120 coincides with the port 116. As a consequence fluid can flow from the cylinder 19 through the fluid line 23 into the corresponding end of the chamber 112, then through the port 115, the valve port 120 and port 116 to the return fluid line 117 to the sump 24. Discharging fluid from the hydraulic cylinder allows the piston to descend and consequently lower the elevator cab.

When the shaft 28 is rotated to a position such that the valve port 125 coincides with the port 122, hydraulic fluid coming from the pump 22 through the fluid line 113 passes through the chamber 111 and is discharged through the valve port 125 and port 122 through the return fluid line 123 back to the sump 24. This removes pressure on the check valve 114 which stops the fluid flow to the cylinder 19, hence stopping the load at a particular stop position. The elevator cab would therefor remain fixed at a particular height depending upon the position of the piston 18.

As the shaft 28 is rotated away from the last described stop position the piston will be raised slowly by reducing the flow of fluid out of the valve port 125, and thereby starting an increasing flow of fluid to the cylinder 19 through the check valve 114.

This occurs when the valve port 125 partially opens the port 122. The valve port 120 may also be positioned in a partially open position to pass fluid out through the return fluid line 117 to provide an intermediate piston lowering speed. The valve elements and their respective valve ports may be positioned to provide some flow of fluid through both valve ports at the same time to provide additional design features.

SEQUENCE OF OPERATION

As an example of operation, let it be assumed that the cab 13, as shown by the solid lines in FIG. 1, is at the second foor, and that it is to be called to the first floor. The call can originate either by pushing the call button 10 on the first floor or pushing the first floor button on the panel 15 in the cab. Having reference to the main electric circuit, as shown in FIG. 5*a*, pressing the first floor switch 1F of section 1 energizes the relay 1C. This means that all 1C relay element contacts are shifted from the positions shown in FIG. 5*a*. For example, relay element $1C_9^6$ and relay element $1C_5^8$, normally open, are shifted to closed positions. Closing of the relay element $1C_5^8$, energizes the down pilot relay DA, section 2, FIG. 5*a*. This results in relay element $DA_7^4$, section 5, FIG. 5*b*, being moved from open to closed position. As a consequence, the down run relay D, section 5, FIG. 5*b*, is closed, but waiting energizing of Hi, 82, FIG. 6*a*. As a further consequence, the balance bridge circuit of FIG. 6*a* is influenced in that down run relay elements D1 and D2, sections 6 and 7, are shifted from open to closed position. At this point there is a calculated delay, awaiting action of the high-speed relay Hi. As previously noted, the high-speed relay Hi is what is conventionally known as a sigma relay designed to energize at 10MA, but which will not be damaged if energized up to 60MA.

Energizing of the down run relay element $DA_1$ of the balance bridge circuit shorts out a portion of the resistance $R1_2$, resulting in a small amount of current going to the amplifier 52 to start the motor 27 rotating the rotary valve for down direction travel. The elevator cab 13 then moves slowly downwardly. This downward motion of the cab, and consequently the scanner 33, causes voltage to be generated in the speed monitoring circuit and the voltage generated, passing through the lines 85 and 86, section 7, FIG. 6*a*, causes the lamps L5 and L6 to glow. L5 illuminates HPD 81, changing its condition to one of conductivity, whereupon the high speed relay 82 is activated, as is also the high speed relay element $Hi_2$, section 6.

At the same time, energizing of the down pilot relay element $DA_3$, section 3, FIG. 5*a*, energizes the down/up switch DUP. This results because the first floor relay 1C and its element $1C_5^8$ had been previously energized. The foregoing sequence of activity shifts the down/up switch DUP to the "up" position in the speed control circuit, section 9, FIG. 6*b*. The newly directed flow of current passing through the lines 91 and 90 causes the lamp L2 to brighten. The down photodetector DPD1, being illuminated, shorts out more of the resistance $R1_2$ which, acting through the amplifier 52, causes the motor 27 to rotate further in a direction, causing a faster down direction movement of the cab 13.

As the cab moves faster, the scanner 33 and its photo detector also moves faster and generates more voltage and further brightens the lamps L5 and L6, section 7, FIG. 6*a*. More light as a result illuminates the high speed photodetector HPD, causing a greater flow through the line 80 and the high speed relay 82. At the same time as the lamp L6 grows brighter, illuminating the down photodetector DPD2, identified as 79, in the line 78, the relay $R2_2$ is shorted out. As the speed of cab 13 gradually increases, the lamp L6 progressively brightens. When the brightness of the lamp L6 matches the brightness of the lamp L2, the bridge circuit is balanced and rotation of the motor 27 stops at whatever the position may be of the rotary valve. When this condition prevails, the speed of the cab 13 is maintained.

As the cab continues to progress downwardly in the hoist way 14, a cam 130 on the cab initially closes a down/slow switch 131 for the first floor, FIG. 1, and section 3 FIG. 5*a*. Closing of the switch 131 energizes the relay C in the same line. The relay element $C_3^9$, section 2, changes from normally closed to open, breaking the circuit through the down pilot DA. As a consequence, the position of the down pilot relay element DA3 is changed which acts to move the down/up switch DUP, identified by the reference character 95, section 9, FIG. 6*b*, to down position as there shown. This change in position cuts off the flow of current through the line 91 to the lamp L2. The dimming is the result of discharging of the capacitors in the speed control circuit of section 9. With less illumination the down photodetector DPD 1, identified by the reference character 70, becomes less conductive, causing an increase in the resistance through $R1_2$. A greater resistance of $R1_2$ relative to $R2_2$ acting through the amplifier 52 causes a rotation of the motor 27 and rotary valve 26 in a reverse direction because of the resulting unbalancing of the balance bridge circuit.

By the time that the resistance $R1_2$ has been reduced to that provided through the down level relay element LD1, the remaining amount of valve opening of the valve 26 will carry the cab 13 to the first floor.

Additionally, as the cab 13 slows down, the scanner 33 moves more slowly, generating less current in the speed monitoring circuit. The lamps L6 and L5 accordingly grow dimmer, the resistance of $R2_2$ increases which effects a balancing of the bridge circuit, and the cab 13 stops.

Further, by word of explanation, when the cam 130 of the cab 13 strikes a down level switch 132, the cab would be normally about six inches above floor level. This down level switch 132 is the relay element LD1. Further still by way of explanation, when the relay C was initially energized, it maintained all of the C relay elements in the same condition until stopping of the cab.

A safety expedient is built into the system by reason of the distribution of the lamps and photodetector strips. For example, since the lamps L5 and L6 are in series, if the lamp L6 should burn out, the lamp L5 would go dark. There being no illumination on the high speed photodetector HPD, identified by the reference character 81, the high speed relay 82 would be deenergized. Deenergization would cause the relay element $Hi_2$ to shift back to open position, at the same time causing the lamp L2 to go dark. The result would be a reversing of the motor inasmuch as the bridge would then be unbalanced in the opposite direction. The cab 13 would then drop to creep speed and stop upon reaching the floor level to which it was called.

An important aspect of the rotary valve expedient is employment of the pendulum 126 on the drive shaft 28. In normal shut-off position of the rotary valve 26, the pendulum is suspended vertically. When the shaft 28 is rotated in one direction or another causing an opening of the rotary valve in such fashion that hydraulic fluid flows either to raise or lower the cab, the pendulum is shifted angularly upwardly. Thereafter, whenever a torque is discontinued in one direction or another of rotation of the shaft 28, the pendulum will return the rotary valve to its previous stop position. In the absence of the pendulum, should power be lost to the motor operating the valve, the elevator would keep on moving with nothing to stop it. With the pendulum on the shaft returning the valve to neutral position, all movement of the cab is stopped.

Although operating details have been traced through for movement of the cab 13 downwardly from an upper floor to a lower floor, the same relative steps are followed when a cab is called upon to move from a lower floor to an upper floor except that it is the left-hand or "up" portion of the balance bridge circuit of FIG. 6*a* which is activated.

THE SCANNER

Figure 3:
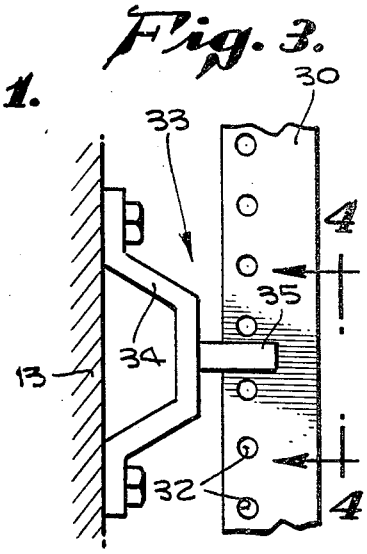
FIG. 3, is an enlarged side elevational view of a photoelectric scanner on the elevator cab.
Figure 4:
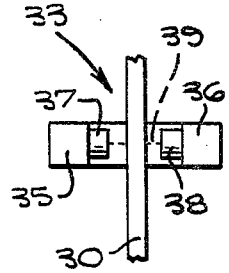
FIG. 4, is a fragmentary elevational view on the line 4—4 of FIG. 3.

Since the primary function of the scanner 33 is to sense the speed of movement of the cab 13 and convert the information into electrical energy, the scanner may take forms other than that of FIGS. 3 and 4.

By way of example there is shown in FIG. 9 a photoelectric scanner 133 on the cab 13 wherein an LED 134 in a cabinet 135 emits a light beam along an outgoing path 136. Stationarily located throughout the hoist way is a strip 137 on which is imprinted a pattern of light colored bars 138 alternating with dark colored bars 139.

Light in the path 136 after impinging on the pattern of bars at a point 140 is reflected along a reverse path 141 to a photodetector 142 wherein the speed of crossing of the bars by the light path is picked up for translation into electrical energy. In the interest of effectiveness an opaque, light-absorbing lining 143 may be employed surrounding the photodetector 142.

Other photoelectric responsive speed detectors may also be restored to as, for example, the mounting of a radar detector of substantially conventional construction on either the top or bottom of the cab 13 directed at a target at the corresponding end of the hoist way. Conversely the radar detector can be stationarily mounted at the end of the hoist way, directed at a target on the cab 13, to detect the speed of travel toward or away from the radar detector.

On occasions a mechanical functioning speed measuring device may be resorted to as, for example, a tac generator of substantially conventional construction. Under such circumstances, as suggested in FIG. 10, a wheel 145 of a tachometer 146 may be made to travel along a track 147 so that speed of rotation of the wheel can be converted into electrical energy and used in the same manner as that of the scanner 33.

While particular embodiments of the present invention have been shown and described, it will be obvious to those skilled in the art that changes and modifications may be made without departing from the invention in its broader aspects and, therefore, the aims of its appended claims are to cover all such changes and modifications as fall within the true spirit and scope of the invention.

Having described the invention, what is claimed as new in support of Letters Patent is as follows:

1. A system for actuating a hydraulic elevator wherein there is a cab responsive to a hydraulic ram to which hydraulic fluid is supplied by a pump and control valve motivated in turn by a motor and its amplifier component for moving said cab between a plurality of floors, said system comprising an electric power source, a main electric circuit for cab travel, and a balance bridge circuit responsive to the main circuit for control of hydraulic fluid fed to the ram whereby to effect cab travel, said balance bridge circuit comprising a first section in communication with the amplifier and motor for driving the motor and valve to adjustments passing fluid in a first direction for moving said cab from floor to floor, and a second section in communication with the amplifier and motor for driving the motor and valve to adjustments passing fluid in a second direction for potential reverse movement of said cab, a speed control circuit in operative association with said balance bridge circuit and including setting means for establishing said speed control circuit at selected speeds, and a speed monitoring circuit in operative association with said balance bridge circuit adapted to constantly correct deviations in said balance bridge circuit from said selected speed, said speed monitoring circuit having a component therein electrically responsive to the rate of travel of said cab at all positions and rates of travel of said cab.

2. A system as in claim 1 wherein said monitoring circuit has a light transmission component and means on the cab in operative association with said light transmitting component for varying the amount of light transmitted in proportion to the rate of travel of said cab.

3. A system as in claim 2 wherein said light transmission component comprises a stationary member and a moving member, a light source and a photodetector having a light transmission path therebetween, the other of said members comprising an intermittent light interruption in said path, said moveable member being located on the cab.

4. A system as in claim 2 wherein said cab is movably mounted in a conventional hoist way between a plurality of floors and said light transmission component comprises a strip stationarily mounted in the hoist way and having transversely extending openings therein, a light source and photodetector on said cab positioned in a manner establishing a light path, said openings in the strip being located in a position adapted to traverse said light path.

5. A system as in claim 1 wherein said balance bridge circuit has a first path of electric travel in said first section and a second path of electric travel in said second section, modifying means in said first section for varying the electric flow in said first path of electric travel, modifying means in said second section for varying the electric flow in said second path of electric travel, the modifying means in one of said sections being responsive to said speed control circuit and the modifying means in the other of said sections being responsive to the speed monitoring circuit, whereby to progressively rebalance the balance bridge circuit upon deviation in the rate of travel of said cab.

6. A system as in claim 5 wherein the modifying means responsive to the speed control circuit comprises a light sensitive component.

7. A system as in claim 5 wherein the modifying means responsive to the speed monitoring circuit comprises a light sensitive component.

8. A system as in claim 5 wherein the modifying means responsive to the speed control circuit and the modifying means responsive to the speed monitoring circuit comprise light sensitive components, there being modifying means for down travel of the cab and other modifying means for up travel of the cab.

9. A system as in claim 5 wherein the modifying means responsive to the speed control circuit comprises a resistance, a bypass electric line across said resistance having therein a first component infinitely resistant in darkness to electric flow and conductive in proportion to the degree of illumination and a light source adjacent said first component responsive to the speed control circuit whereby to unbalance the balance bridge circuit and rotate said valve to a position effecting movement of said cab in a first selected direction.

10. A system as in claim 5 wherein the modifying means responsive to the speed monitoring circuit comprises a resistance, a bypass electric line across said resistance having therein a second component infinitely resistant in darkness to electric flow and conductive in proportion to the degree of illumination, and a light source adjacent said second component responsive to the speed monitoring circuit, whereby to rebalance the balance bridge circuit and rotate said valve to a position effecting potential movement of said cab in a direction adverse to initial movement.

11. A system as in claim 5 wherein the modifying means in response to the speed control circuit and the modifying means in response to the speed monitoring circuit both comprise a resistance, a bypass electric line across said resistance having therein a component infinitely resistant in darkness to electric flow and conductive in proportion to the degree of illumination and a light source adjacent each respective component, a first of said light sources being responsive to the speed control circuit and a second of said light sources being responsive to the speed monitoring circuit, there being an electric line across both said sections having therein a third component infinitely resistant in darkness to electric flow and conductive in proportion to the degree of illumination, and a light source adjacent said third component which is in series with the light source responsive to the speed monitoring circuit, and relay means subject to activation by said third component, there being an element of said relay means in series with the light source responsive to the speed control circuit whereby to deenergize said last identified light source when the light source for said third component is deenergized.

12. A system as in claim 1 wherein said speed control circuit is successively responsive to activation of said speed monitoring circuit whereby to establish the speed of travel of said cab.

13. A system as in claim 12 wherein said speed control circuit comprises an adjustment whereby to vary the cab speed for which the speed control circuit is operative.

14. A system as in claim 1 wherein said main electric circuit comprises call switches for respective floors, and a start component for said balance bridge circuit potentially in series respectively with the call switches of the respective floors.

15. A system as in claim 14 wherein there is a slow travel switch means in said main electric circuit responsive to cab actuation, said speed control circuit being subject to activation by said slow travel switch means whereby to motivate said balance bridge circuit to a slow down mode.

16. A system as in claim 1 wherein said control valve is a valve with a rotating valve element, said motor having a rotating drive shaft in driving relationship with said rotating drive element.

17. A system as in claim 16 wherein said motor and valve are subject to rotation selectively in opposite directions in response to selective balancing and unbalancing of said balance bridge circuit.

* * * * *